US007986278B2

(12) United States Patent
Wu

(10) Patent No.: US 7,986,278 B2
(45) Date of Patent: Jul. 26, 2011

(54) SLOT ANTENNA

(75) Inventor: Sueng-Chien Wu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 331 days.

(21) Appl. No.: 12/211,039

(22) Filed: Sep. 15, 2008

(65) Prior Publication Data

US 2009/0284428 A1 Nov. 19, 2009

(30) Foreign Application Priority Data

May 16, 2008 (TW) ..... 97208529 U

(51) Int. Cl.
*H01Q 13/10* (2006.01)

(52) U.S. Cl. ..... 343/767; 343/746; 343/700 R

(58) Field of Classification Search ..... 343/767, 343/746, 771, 700 R, 770
See application file for complete search history.

(56) References Cited

U.S. PATENT DOCUMENTS

| | | | | |
|---|---|---|---|---|
| 4,006,481 | A * | 2/1977 | Young et al. | 343/770 |
| 6,703,983 | B2 * | 3/2004 | Huang | 343/768 |
| 2005/0243005 | A1 * | 11/2005 | Rafi et al. | 343/767 |
| 2009/0262028 | A1 * | 10/2009 | Mumbru et al. | 343/702 |

FOREIGN PATENT DOCUMENTS

TW I269485 6/2007

* cited by examiner

*Primary Examiner* — Douglas W Owens
*Assistant Examiner* — Jae K Kim
(74) *Attorney, Agent, or Firm* — Frank R. Niranjan

(57) ABSTRACT

A slot antenna positioned on a substrate includes a grounding portion, a radiating portion, and a feeding portion. The grounding portion is positioned on the substrate. The radiating portion is parallel to the grounding portion and shaped like an irregular octagon. The radiating portion includes an irregular slot that is defined substantially in the center of the irregular octagon. The feeding portion electrically connects the radiating portion to the grounding portion for feeding electromagnetic signals.

9 Claims, 6 Drawing Sheets

SLOT ANTENNA

BACKGROUND

1. Field of the Invention

Embodiments of the present disclosure relate to antennas, and particularly, to a slot antenna.

2. Description of Related Art

Recently, there has been significant growth in wireless communication technology due to a growing demand for wireless communication devices. Antennas are essential components in wireless communication devices for radiating electromagnetic signals. The frequency band and stability of antennas are especially key in the design of antennas.

Wideband slot antennas are very widespread in the research and application of antennas. Due to temperature variation, frequency offsets of slot antennas often occur. Consequently, slot antennas are required to have a wide and stable frequency band that is not affected by the temperature.

SUMMARY

An exemplary embodiment of the present disclosure provides a slot antenna. The slot antenna is positioned on a substrate. The slot antenna comprises a grounding portion, a radiating portion, and a feeding portion. The grounding portion is positioned on the substrate. The radiating portion is parallel to the grounding portion and shaped like an irregular octagon. The radiating portion comprises an irregular slot is defined substantial in the center of the irregular octagon. The feeding portion electrically connects the radiating portion to the grounding portion for feeding electromagnetic signals.

Other advantages and novel features of the present disclosure will become more apparent from the following detailed description of certain inventive embodiments when taken in conjunction with the accompanying drawings, in which:

DETAILED DESCRIPTION

Figure 1:
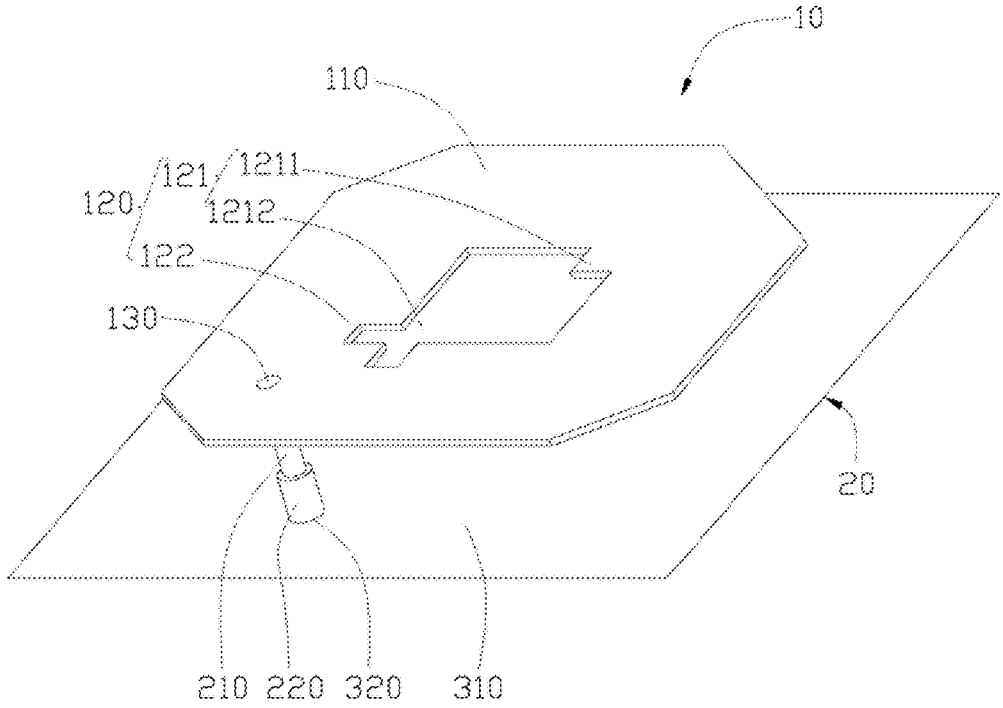
FIG. 1 is a schematic diagram of a slot antenna in accordance with an exemplary embodiment of the present disclosure.
Figure 2:
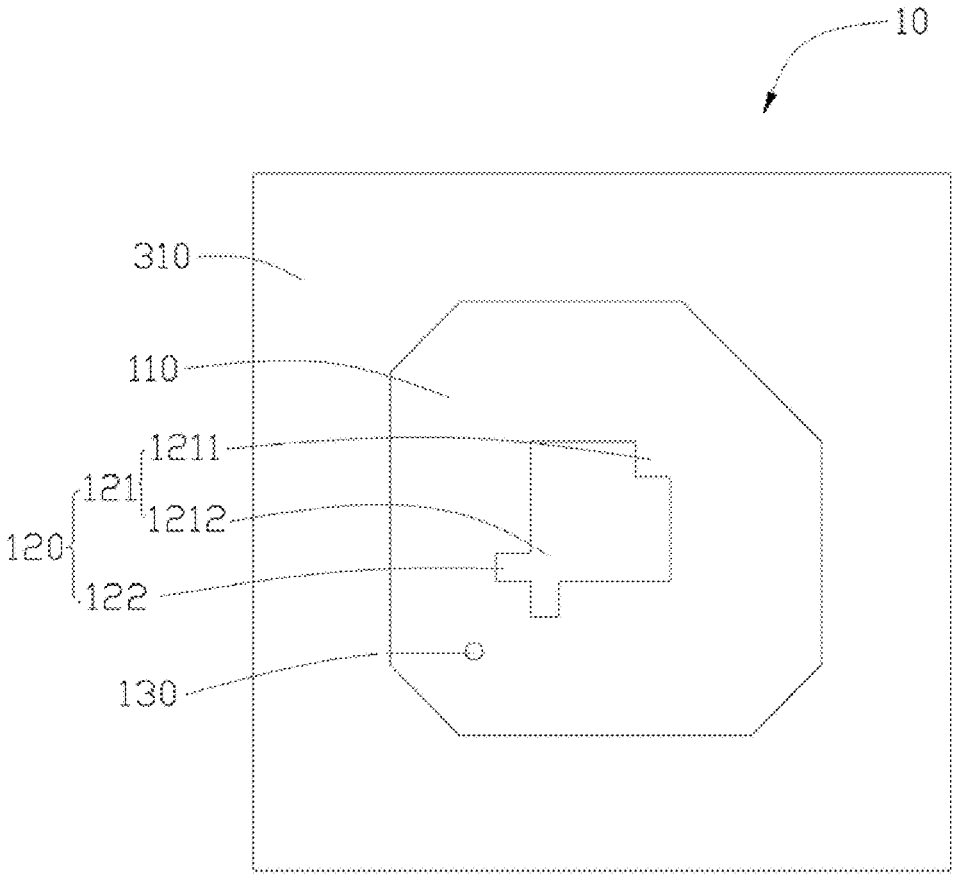
FIG. 2 is similar to FIG. 1, but showing a top view of one embodiment of the slot antenna of FIG. 1.

FIG. 1 is a schematic diagram of a slot antenna 10 in accordance with an exemplary embodiment of the present disclosure. As shown, the slot antenna 10 is positioned on a substrate 20 and includes a radiating portion 110, a feeding portion 210, and a grounding portion 310. The grounding portion 310 is positioned on the substrate 20.

The radiating portion 110 is parallel to the grounding portion 310 and shaped like an irregular octagon. An irregular slot 120 is defined substantially in the center of the irregular octagon to improve the radiation performance of the antenna 10. In one embodiment, the irregular slot 120 includes a rectangular-shaped slot 121 and an L-shaped slot 122. The L-shaped slot 122 communicates with one corner 1211 of the rectangular-shaped slot 121. Another corner 1212 of the rectangular-shaped slot 121 opposite to said one corner 1211 extends inward towards the L-shaped slot 122. The feeding portion 210 connects to the radiating portion 110 via a joint 130 on the corner portion of the radiating portion 110 in which the L-shaped slot 122 is positioned. In one embodiment, the feeding portion 210 is cylindrically-shaped and electrically connected to the joint 130 through a soldering process, in one embodiment.

The feeding portion 210 electrically connects the radiating portion 110 to the grounding portion 310.

The grounding portion 310 defines a conductive via 320. In one embodiment, the projection of the feeding portion 130 onto the grounding portion 310 is within the conductive via 320.

The slot antenna 10 further includes a connecting portion 220 that connects the feeding portion 210 to the grounding portion 310 through the conductive via 320. In one embodiment, the connecting portion 220 is hollow and cylindrically-shaped. The connecting portion 220 and the feeding portion 210 are tightly coupled together and can easily be connected or disconnected. In one embodiment, the connecting portion and the feeding portion may frictionally coupled together.

In one embodiment, the grounding portion 310 and the radiating portion 110 are made of the same materials. In one particular embodiment, the grounding portion 310 and the radiating portion 110 may be made of iron for reducing the manufacturing cost. However, it may be understood that the material of the grounding portion 310 and the radiating portion 110 may comprise other materials, such as aluminum and ceramic.

In one embodiment, the gap between the grounding portion 310 and the radiating portion 110 is filled with air. As a result of the gap between the grounding portion 310 and the radiating portion 110 being filled with air, the slot antenna 10 has a stable frequency that is substantially not affected by the temperature.

Figure 3:
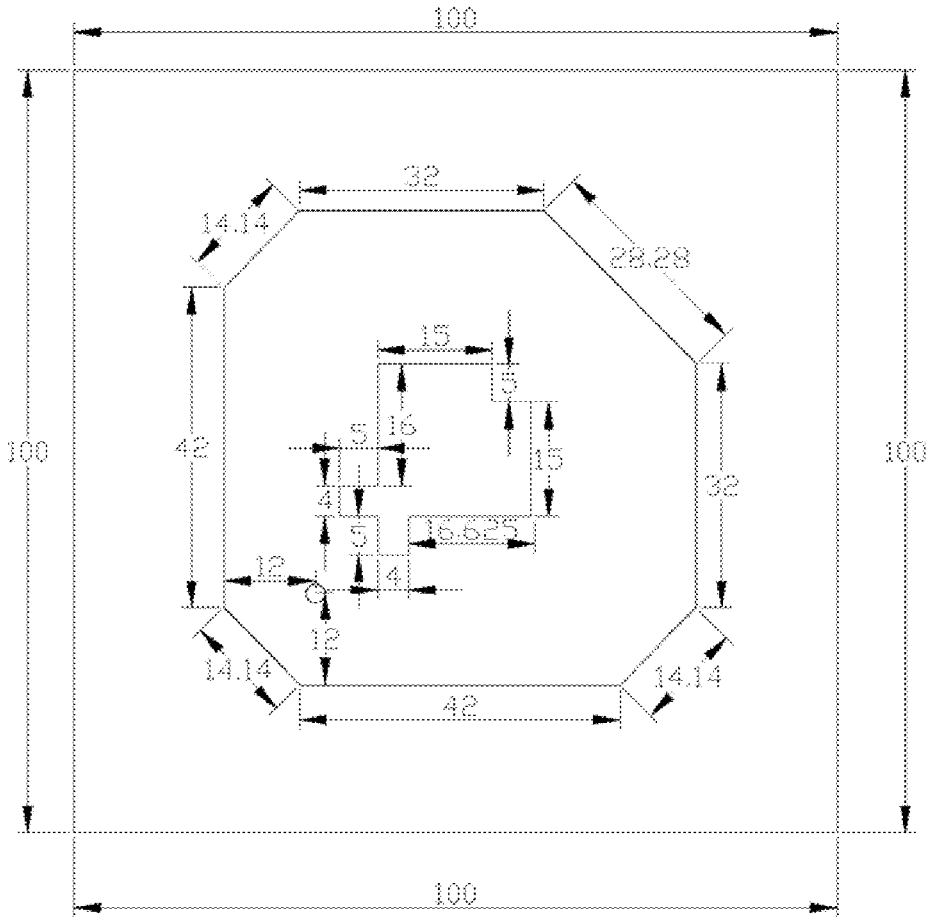
FIG. 3 illustrates one exemplary embodiment of dimensions of the slot antenna of FIG. 1.

FIG. 3 illustrates one exemplary embodiment of dimensions of the slot antenna 10 of FIG. 1. In one embodiment, the grounding portion 310 is square-shaped and has a length of approximately 100 millimeters (mm). Lengths of the radiating portion 110 are approximately 32 mm, 14.14 mm, 42 mm, 14.14 mm, 42 mm, 14.14 mm, 32 mm, and 28.28 mm, counter-clockwise and starting from the top end as depicted in FIG. 3. The rectangular slot 121 is square-shaped and has a length of approximately 20 mm. Similarly, the corner extended is square-shaped and the length of the corner is approximately 5 mm. The length of the L-shaped slot 122 is approximately 5 mm and has a width of approximately 4 mm.

Figure 4:
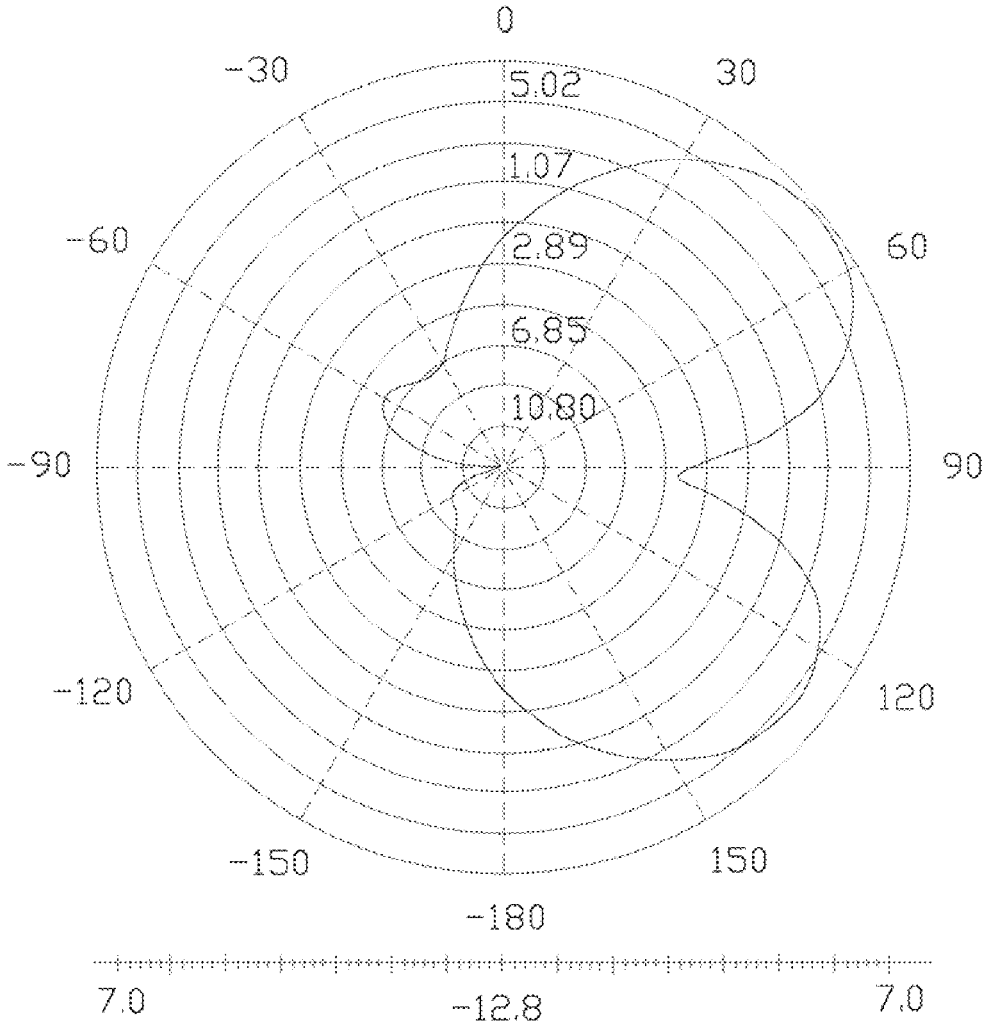
FIGS. 4-5 are test charts showing exemplary radiation patterns of one embodiment of the slot antenna of FIG. 1 with 45° and 60° angles, respectively.
Figure 5:
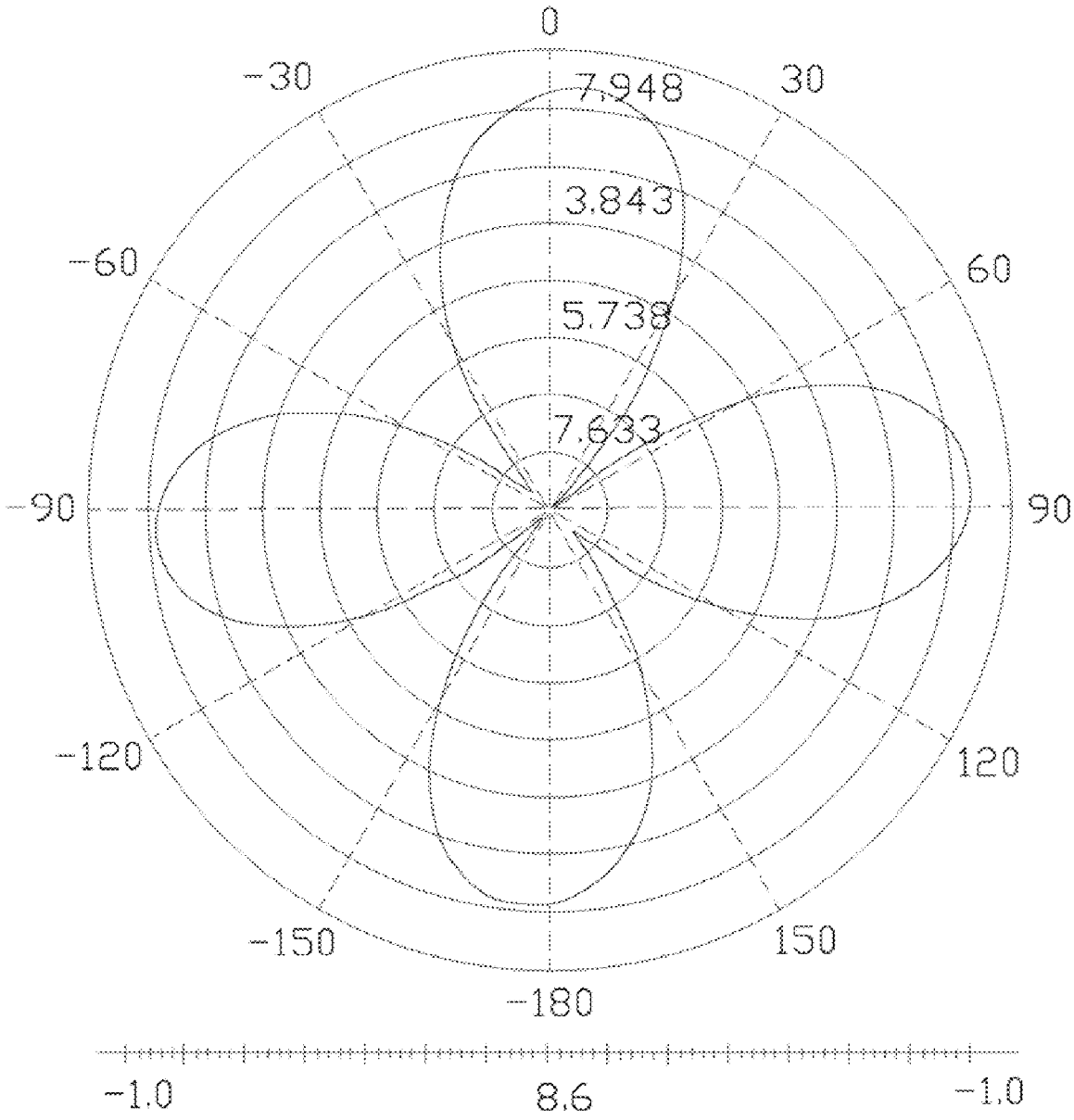

FIGS. 4-5 are test charts showing exemplary radiation patterns of one embodiment of the slot antenna 10 of FIG. 1 with 45° and 60° angles, respectively. As shown, the slot antenna 10 can radiate at any angle and is quantified in accordance with application requirements.

Figure 6:
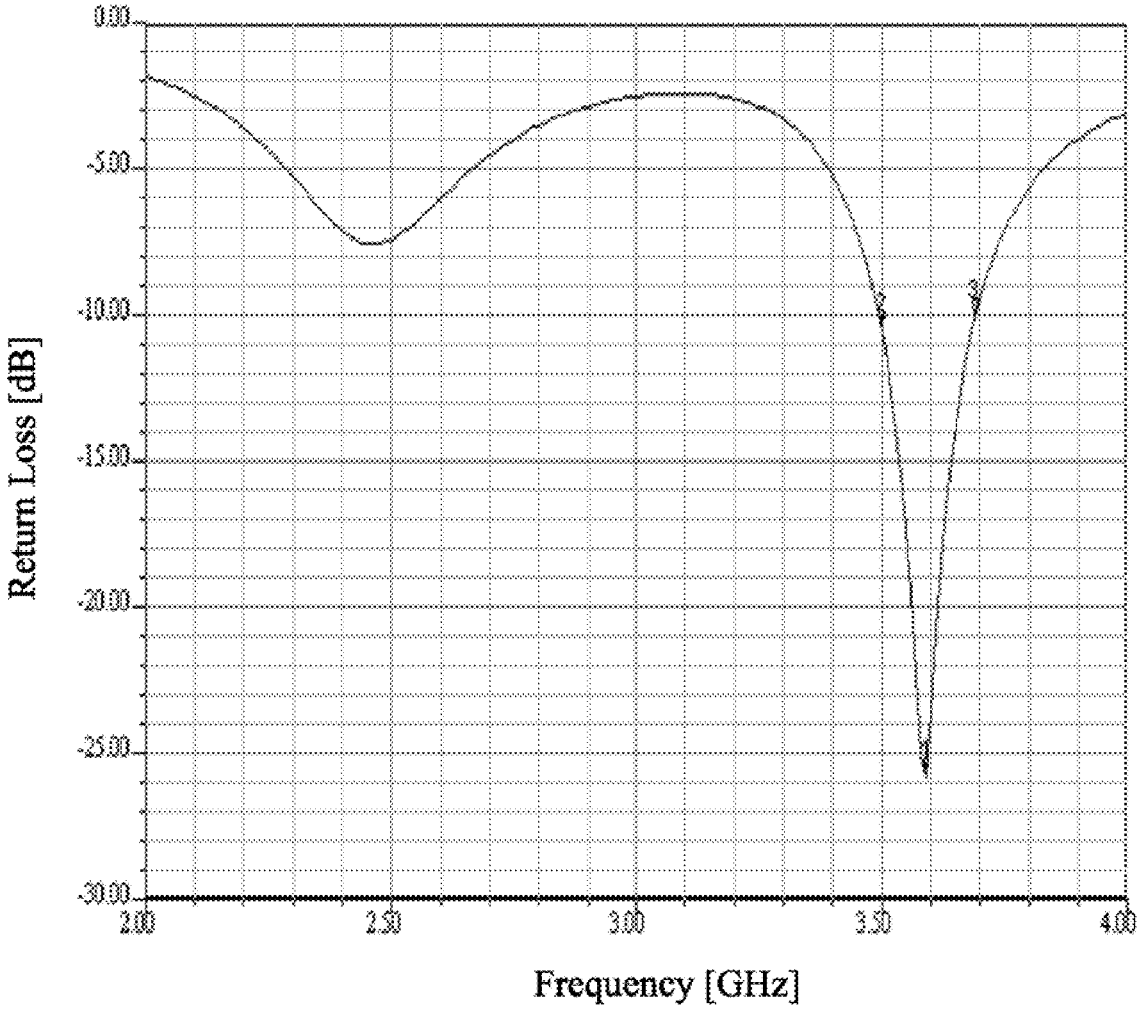
FIG. 6 is a graph showing one exemplary embodiment of a return loss of the slot antenna of FIG. 1.

FIG. 6 is a graph showing one exemplary embodiment of a return loss of the slot antenna 10 of FIG. 1. As shown, when the slot antenna 10 operates in frequency bands of approximately 3.5-3.7, the return loss is less than −10 dB.

The description of the present disclosure has been presented for purposes of illustration and description, and is not intended to be exhaustive or limited to the disclosure in the form disclosed. Many modifications and variations will be apparent to those of ordinary skill in the art. The embodiment was chosen and described in order to best explain the principles of the disclosure, the practical application, and to enable others of ordinary skill in the art to understand the disclosure for various embodiments with various modifications as are suited to the particular use contemplated.

What is claimed is:

1. A slot antenna positioned on a substrate, comprising:

a grounding portion positioned on the substrate;

a radiating portion parallel to the grounding portion and shaped like an irregular octagon comprising an irregular slot being defined in substantially in the center of the irregular octagon, wherein the irregular slot is defined by a rectangular-shaped slot and an L-shaped slot communicating with one corner of the rectangular-shaped slot; and a feeding portion electrically connecting the radiating portion to the grounding portion for feeding electromagnetic signals.

2. The slot antenna as recited in claim 1, wherein another corner of the rectangular-shaped slot opposite to said one corner extends inward towards the L-shaped slot.

3. The slot antenna as recited in claim 1, a joint consisting of the feeding portion and the radiating portion is positioned at a corner portion of the radiating portion close to the L-shaped slot.

4. The slot antenna as recited in claim 1, further comprising a connecting portion connecting the grounding portion to the feeding portion.

5. The slot antenna as recited in claim 4, wherein the feeding portion is cylindrically-shaped, and the connecting portion is hollow and cylindrically-shaped.

6. The slot antenna as recited in claim 5, wherein the feeding portion and the connecting portion are tightly coupled together.

7. The slot antenna as recited in claim 6, wherein the feeding portion and the connecting portion can easily be connected or disconnected.

8. The slot antenna as recited in claim 1, wherein the grounding portion and the radiating portion are made of the same materials.

9. The slot antenna as recited in claim 8, wherein the material of the grounding portion and the radiating portion are made of iron.

* * * * *